US008776568B2

(12) United States Patent
Tomizawa et al.

(10) Patent No.: US 8,776,568 B2
(45) Date of Patent: Jul. 15, 2014

(54) BENT MEMBER AND AN APPARATUS AND METHOD FOR ITS MANUFACTURE

(75) Inventors: Atsushi Tomizawa, Minou (JP); Hiroaki Kubota, Nishinomiya (JP); Shinjiro Kuwayama, Osaka (JP); Saburo Inoue, Tama (JP)

(73) Assignees: Nippon Steel & Sumitomo Metal Corporation, Tokyo (JP); Sumitomo Pipe & Tube Co., Ltd., Ibaraki (JP)

( * ) Notice: Subject to any disclaimer, the term of this patent is extended or adjusted under 35 U.S.C. 154(b) by 0 days.

(21) Appl. No.: 13/404,366

(22) Filed: Feb. 24, 2012

(65) Prior Publication Data

US 2013/0059167 A1 Mar. 7, 2013

Related U.S. Application Data

(63) Continuation of application No. PCT/JP2010/064145, filed on Aug. 23, 2010.

(30) Foreign Application Priority Data

Aug. 25, 2009 (JP) ..... 2009-194211

(51) Int. Cl.
*B21D 37/16* (2006.01)

(52) U.S. Cl.
USPC ..... 72/342.6; 72/128; 72/342.5; 72/369

(58) Field of Classification Search
USPC ..... 72/128, 342.1, 342.2, 342.5, 342.6, 72/342.94, 342.96, 369
See application file for complete search history.

(56) References Cited

U.S. PATENT DOCUMENTS

| | | | | |
|---|---|---|---|---|
| 1,996,838 | A * | 4/1935 | Snell | 72/128 |
| 2,286,893 | A * | 6/1942 | Boissou | 72/305 |
| 2,480,774 | A * | 8/1949 | Rossheim et al. | 72/128 |
| 2,609,859 | A * | 9/1952 | Fichtmueller | 72/31.05 |

(Continued)

FOREIGN PATENT DOCUMENTS

| | | |
|---|---|---|
| CA | 0268215 | 10/2008 |
| CA | 2682815 | 10/2008 |

(Continued)

OTHER PUBLICATIONS

Jidosha Gijutsu, Journal of Society of Automotive Engineers of Japan, vol. 57, No. 6, 2003, pp. 23-28.

(Continued)

*Primary Examiner* — Edward Tolan
(74) *Attorney, Agent, or Firm* — Clark & Brody

(57) ABSTRACT

A bent member having a bent portion with an extremely small bend radius is manufactured by supporting a rectangular tube by a first support means disposed at a first position A while performing relative feeding of the rectangular tube in its lengthwise direction, locally heating the rectangular tube by a heating means disposed at a second position B, cooling the rectangular tube by a cooling means disposed at a third position C, and at the time of working, applying a shear force to the heated portion of the rectangular tube with a shear force applying means 14 disposed in a downstream region D by moving the device 14 two-dimensionally or three-dimensionally simultaneously in the feed direction of the rectangular tube and in a direction generally parallel to a transverse cross section in the lengthwise direction of the rectangular tube which was heated by the heating means.

35 Claims, 5 Drawing Sheets

(56) References Cited

U.S. PATENT DOCUMENTS

| | | | | | |
|---|---|---|---|---|---|
| 2,812,004 | A | * | 11/1957 | Huet | 72/154 |
| 2,835,151 | A | * | 5/1958 | Fuchs, Jr. et al. | 72/331 |
| 3,368,377 | A | * | 2/1968 | Hirayama et al. | 72/128 |
| 3,473,361 | A | * | 10/1969 | Cwik | 72/150 |
| 4,061,005 | A | * | 12/1977 | Kawanami et al. | 72/21.4 |
| 4,122,697 | A | * | 10/1978 | Hanyo et al. | 72/128 |
| 4,689,981 | A | * | 9/1987 | Ibrahim et al. | 72/150 |
| 6,189,354 | B1 | * | 2/2001 | Spath | 72/31.07 |
| 2008/0257004 | A1 | * | 10/2008 | Spaeth | 72/167 |

FOREIGN PATENT DOCUMENTS

| | | | | |
|---|---|---|---|---|
| JP | 5-154566 | * | 6/1993 | B21D 7/08 |
| JP | 2000-210722 | | 8/2000 | |
| JP | 2007-83304 | | 4/2007 | |
| WO | 2006/093006 | | 9/2006 | |
| WO | 2008/123505 | | 10/2008 | |

OTHER PUBLICATIONS

"Dieless Bending of Shaped Tubes", Sosei to Kako, Journal of the Japan Society for Technology of Plasticity, vol. 28, No. 313, Feb. 1987, pp. 158-165.

"Techniques for Bending a Pipe with a Zero Radius" , Sosei Kako, Journal of the Japan Society for Technology of Plasticity, vol. 35, No. 398, Mar. 1994, pp. 232-237.

* cited by examiner

BENT MEMBER AND AN APPARATUS AND METHOD FOR ITS MANUFACTURE

TECHNICAL FIELD

This invention relates to a bent member and an apparatus and method for its manufacture. Specifically, the present invention relates to a bent member having an extremely small bent portion with a bend radius which is, for example, at most 1-5 times its wall thickness (the thickness of a blank or a member being worked) and to an apparatus and method for its manufacture.

BACKGROUND ART

Strength members, reinforcing members, and structural members made of metal and having a bent shape which are used in automobiles, various types of machines, and the like need to have a high strength, a low weight, and a small size. Up to now, these bent members have been manufactured by methods such as welding of stamped parts, punching of thick plates, and forging. It is difficult to further reduce the weight and size of bent members which are manufactured by these methods.

Non-Patent Document 1 discloses the manufacture of this type of bent member by the so-called tube hydroforming technique. Page 28 of Non-Patent Document 1 discloses that tube hydroforming has the problems of developing materials for blanks to be worked and increasing the degree of freedom of shapes which can be formed. Further development in the future is necessary in order to manufacture this type of bent member by tube hydroforming.

The present applicant disclosed a bending apparatus in Patent Document 1. FIG. 7 is an explanatory view schematically showing such bending apparatus 1.

As shown in FIG. 7, the bending apparatus 1 manufactures a bent member 7 made of steel by carrying out bending of a steel tube 2, which is supported by a pair of support means 3,3 so as to movable in its axial direction, in the manner described below on the downstream side of the support means 3, 3 while feeding the steel tube 2 in the direction of the arrow by an unillustrated feed device from the upstream side to the downstream side.

A high frequency heating coil 4 disposed on the downstream side of the support means 3, 3 rapidly heats the steel tube 2 to a temperature range in which local quench hardening is possible. A water cooling device 5 disposed on the downstream side of the high frequency heating coil 4 rapidly cools the steel tube 2. A movable roller die 6 having at least one set of roll pairs 6*a*, 6*a* which can support the steel tube 2 while feeding it varies its position three-dimensionally (or in some cases two-dimensionally) to apply a bending moment to the high temperature region 2*a* of the steel tube 2. Therefore, the bending apparatus 1 can manufacture a bent member 7 with high operating efficiency.

Non-Patent Document 2 discloses a technique for dieless bending of a metal tube by which a metal member having an elliptical cross section is continuously fed, and while supporting the metal member being fed by a support device so that the member can move, rapid heating of the metal member with a high frequency heating device disposed downstream of the support device and rapid cooling of the metal member with a water cooling device disposed immediately downstream of the high frequency heating device are performed, and while gripping the metal member with an arm which can rotate two-dimensionally and which is disposed downstream of the rapid cooling device, the arm is rotated to apply a bending moment to the high temperature region of the metal member. The technique disclosed by Non-Patent Document 2 does not form a complicated shape which is bent two-dimensionally or three-dimensionally like the invention disclosed in Patent Document 1, and it is also not intended to produce an increase in strength by quench hardening.

Non-Patent Document 2 discloses the dimensions of each portion of a bent member in which an elongated flat metal blank having a hollow closed cross-sectional shape and an integral structure in the lengthwise direction is bent to a two-dimensional shape having a constant bend radius by carrying out local rapid heating and cooling of the blank while feeding it in its lengthwise direction.

According to the investigations of the present inventors, the bending apparatus disclosed in Patent Document 1 and the technique disclosed in Non-Patent Document 2 can manufacture a bent member having a bent portion with a bend radius which is 1 to 2 times the diameter of a metal tube (in the case of a rectangular cross section, the length of a side in the bending direction of a metal tube). However, with such technique, it is difficult to perform mass production at a low cost of bent members having a bent portion with an extremely small bend radius (such as at most 1-5 times the wall thickness) which are commonly used in automotive parts such as components of automotive bodies or suspensions or chassis.

FIG. 8 is an explanatory view showing the change in the dimensions of the cross section of a hollow member before and after the bending disclosed in Patent Document 1 and Non-Patent Document 2. FIG. 8 shows the case in which bending is first carried out with a bend radius R1 and then is carried out in the opposite direction with a bend radius R2.

As shown in FIG. 8, when bending is carried out by applying a bending moment to a profiled tube 8*a* having a rectangular cross section with a width $W_0$ and a height $H_0$, the width of the resulting bent member 8*b*, which is a product after the completion of bending, is $W_1$, which is smaller than the width $W_0$ before bending by a small amount $\Delta W$ ($W_1=W_0-\Delta W$). In addition, the height $H_B$ of the product on side B, which is the inner peripheral side of bending, is increased by a minute amount $\Delta H$ with respect to the height $H_0$ before bending ($H_B=H_0+\Delta H$), while the height $H_A$ on side A, which is the outer peripheral side of bending, decreases by a minute amount $\Delta H'$ compared to the height $H_0$ before bending ($H_A=H_0-\Delta H'$).

As disclosed in Non-Patent Document 2, when a bent member 8*b* is manufactured by bending of an elongated flat metal blank 8*a* having a hollow closed cross-sectional shape and an integral structure in the lengthwise direction, in a portion where bending is performed, the width and height of a cross section vary from the dimensions before bending. Wrinkles develop on the inner peripheral side of bending and the cross-sectional shape deforms, and as a result, the dimensional accuracy of the bent member 8*b* decreases. The extent of the decrease in dimensional accuracy depends on the dimensions of the blank 8*a* before bending (the width $W_0$, the height $H_0$, the wall thickness t, etc.) as well as the bending conditions (the bend radius R, the heated width b, etc.).

If it is attempted to manufacture a bent member having a bent portion with an extremely small bend radius R (such as at most 1-5 times the wall thickness of a hollow member) by the bending apparatus disclosed in Patent Document 1 or the technique disclosed in Non-Patent Document 2, the dimensional accuracy of the resulting bent member greatly decreases, and it is not possible to manufacture a bent member having excellent dimensional accuracy.

Non-Patent Document 3 discloses a technique for manufacturing a stainless steel tube which is formed into the shape of a crank having a bent portion with an extremely small radius by cold working. According to this technique, a SUS 304 stainless steel tube is disposed inside a sectional die which is split into an upper section and a lower section and which constrains expansion of the steel tube, shear deformation in a plane at 45 degrees to the axis of the steel tube is developed by moving the outer die in a direction perpendicular to the steel tube while applying an internal pressure p to the steel tube and pressing the end surface of the tube in the axial direction with a load F, and the location where deformation takes place is continuously moved as the outer die moves.

PRIOR ART DOCUMENTS

Patent Documents

Patent Document 1: WO 2006/093006

Non-Patent Documents

Non-Patent Document 1: Jidosha Gijutsu (Journal of Society of Automotive Engineers of Japan), Vol. 57, No. 6, 2003, pages 23-28 Non-Patent Document 2: "Dieless Bending of Shaped Tubes", Sosei to Kako (Journal of the Japan Society for Technology of Plasticity), Vol. 28, No. 313 (February 1987), pages 158-165

Non-Patent Document 3: "Techniques for Bending a Pipe with a Zero Radius", Sosei to Kako (Journal of the Japan Society for Technology of Plasticity), Vol. 35, No. 398 (March 1994), pages 232-237

DISCLOSURE OF INVENTION

In the technique which is disclosed by Non-Patent Document 3, a stainless steel tube, which is a blank to be bent, is disposed inside a sectional die having an upper section and a lower section, and cold bending is performed thereon while applying pressure to the interior of the stainless steel tube. Therefore, in order to carry out this technique, at least a sectional die split into upper and lower sections which has a shape corresponding to the bent shape and a pressurizing device for applying pressure to the interior of the steel tube are necessary. As a result, a large increase in manufacturing cost is unavoidable when carrying out mass production of to many types of bent members by this technique.

Non-Patent Document 3 in fact states that it was possible to carry out bending on a SUS 304 stainless steel tube having an outer diameter of 22.2 mm and a wall thickness of 1 mm or 0.3 mm to form a bent portion having an extremely small radius. However, due to bending by cold working, if similar bending is performed on a high strength member, there is the possibility of cracks developing in the blank.

With this technique, it is particularly difficult to perform bending on a blank with a strength of 980 MPa or above. Furthermore, even if cracking is avoided, the load which must be applied during working of a high strength steel tube or a steel tube with a large wall thickness becomes extremely high. As a result, equipment used for working must be quite large, and equipment costs markedly increase.

Therefore, even with the technique disclosed in Non-Patent Document 3, it is difficult to perform mass production at a low cost of a bent member having a bent portion with an extremely small bend radius (such as at most 1-5 times the wall thickness), and it is not possible to perform working of a high strength blank tube.

The object of the present invention is to provide with certainty and at a low cost a bent member having a bent portion with an extremely small bend radius such as one which is at most 1-5 times the wall thickness and which does not have any decrease in dimensional accuracy caused by the occurrence of wrinkles or a collapse of the cross-sectional shape on the inner peripheral side of the bent portion, thereby increasing the degree of freedom of design of components of automobiles such as components of a vehicle body or a suspension or chassis and reducing the cost and weight of these components.

The present inventors performed diligent investigations based on the idea that the above-described problems can be overcome if the bending technique disclosed in Non-Patent Document 3 can be carried out in a hot or a warm state. As a result, the present inventors found that by moving the roll pair 6*a*, 6*a* shown in FIG. 7 two-dimensionally or three-dimensionally so as to apply a shear stress to a heated surface of a steel tube 2 and thereby carry out working, it is possible to mass to produce at a low cost and with certainty a bent member which has a bent portion with an extremely small bend radius such as at most 1-5 times the wall thickness and which does not have a decrease in dimensional accuracy caused by the occurrence of wrinkles or a collapse of the cross-sectional shape on the inner peripheral side of the bent portion. As a result of further investigations, they completed the present invention.

The present invention is an apparatus for manufacturing a bent member characterized by comprising a first support device which supports a hollow metal blank while performing relative feeding of the blank in its lengthwise direction, a heating device which heats the blank, a cooling device which cools (by forced cooling or natural cooling) a second portion of the blank located downstream of a first portion which is heated by the heating device in the relative feed direction of the blank, a shear stress applying device, such as a clamp, for example (such as a pair of rolls which oppose and are separated from each other or a clamping device), which applies a shear stress to the blank between the first portion and the second portion by moving two-dimensionally or three-dimensionally.

From another standpoint, the present invention is a method of manufacturing a bent member characterized in that while relatively feeding a hollow metal blank in its lengthwise direction with respect to a first support device which supports the blank, heating of the blank by a heating device and cooling thereof by a cooling device of a second portion of the blank located downstream of a first portion which was heated by the heating device are performed, and working of the blank is performed by two-dimensional or three-dimensional movement of a shear force applying device which applies a shear force to the blank in a position between the first portion and the second portion by moving two-dimensionally or three-dimensionally. In this method, quench hardening is preferably carried out between the first portion and the second portion.

In an embodiment of the present invention, the first support device, the heating device, and the cooling device are each fixed in place wherein the first support device is disposed at a first position, the heating device is disposed at a second position downstream of the first position in the feed direction of the blank, and the cooling device is disposed at a third position downstream of the second position in the feed direction of the blank, and the shear force applying device is disposed in a region downstream of the third position in the feed direction of the blank.

In the present invention, it is preferred that the heating device heat a transverse cross section in the lengthwise direction of the blank and that the shear force applying device move both in the feed direction of the blank and in a direction generally parallel to the transverse cross section.

In the present invention, it is preferred that (a) a second support device be provided which supports a portion of the blank on which working by the shear force applying device has been completed in a region downstream of the installation position of the shear force applying device in the feed direction of the blank, or (b) positioning of the shear force applying device be carried out by clamping (gripping or holding) the blank.

In the present invention, it is also preferred that the bent member satisfy at least one of the following: (c) it has at least one bent portion having an extremely small bend radius (such as at most 1-5 times the wall thickness), (d) it has at least one bent portion which was heated and cooled, and (e) it has a closed cross-sectional shape and an integral structure in the lengthwise direction (it is hollow and elongated).

From yet another standpoint, the present invention is a bent member which is characterized by having a hollow metal body having at least one bent portion which is formed in the body and which is bent two-dimensionally or three-dimensionally, with the bend radius of the bent portion being extremely small (such as at most 1-5 times the wall thickness).

In the present invention, the bent portion is preferably a portion which was heated and cooled during working to form the bent portion.

In the present invention, the bent member preferably has a closed cross-sectional shape and an integral structure in the lengthwise direction.

According to the present invention, it is possible to provide at low cost and with certainty a bent member having a bent portion with an extremely small bend radius such as at most 1-5 times the wall thickness and which has no decrease in dimensional accuracy caused by the occurrence of wrinkles or a collapse of the cross-sectional shape on the inner peripheral side of the bent portion. Therefore, according to the present invention, it is possible to increase the degree of freedom of design of various automotive parts such as components of automotive bodies or suspensions or chassis and to achieve a further decrease in the cost and weight of these components.

Figure 1:
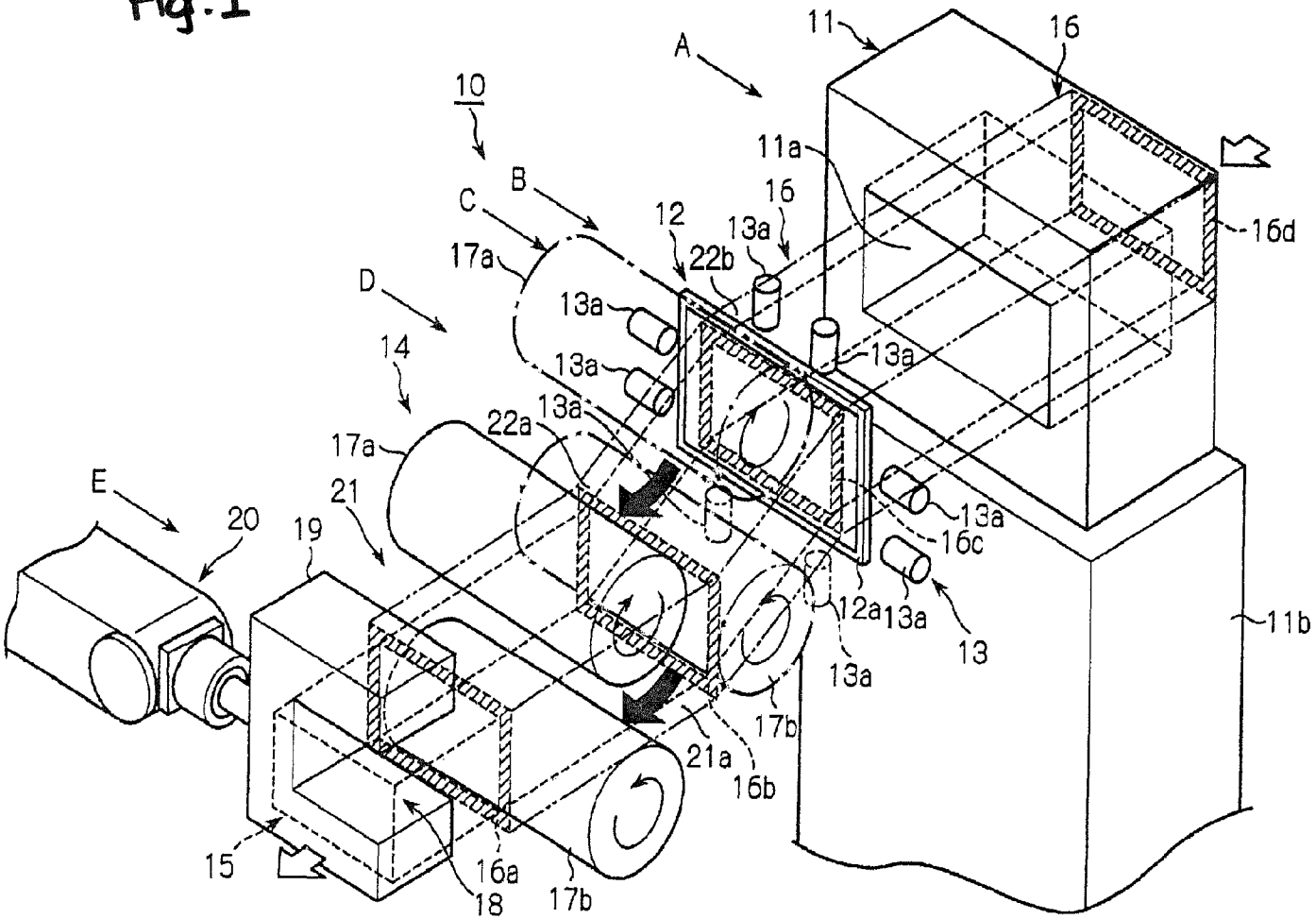
FIG. 1 is a perspective view of an example of the structure of a manufacturing apparatus according to the present invention in partially simplified and abbreviated form.

1: bending apparatus disclosed in Patent Document 1
2: steel tube
3: support device
4: induction heating coil
5: water cooling device
6: movable roller die
6*a*: roll
7: bent member
8*a*: profiled tube
10*b*: bent member
10, 10-1, 10-2, 10-3: manufacturing apparatuses according to the present invention
11: first support device
11*a*: through hole
12: heating device
12*a*: induction heating coil
13: cooling device
13*a*: cooling water spraying nozzle
14: shear force applying device
15: second support device
16: rectangular tube
16*a*-16*d*: cross-sectional shape
17*a*, 17*b*: rolls
18: chuck
19: end effector
20: vertical articulated industrial robot
21: bent member
21*a*: body
22*a*, 22*b*: bent portions
23*a*, 23*b*: rolls
24: industrial robot

MODES FOR CARRYING OUT THE INVENTION

Below, best modes for carrying out the present invention will be explained to while referring to the attached drawings. In the following explanation, an example will be given of the case in which a bent member which is manufactured by the present invention is a strength member, a reinforcing member, or a structural member used in automobiles and various machines and which is manufactured from a blank in the form of a hollow member made of steel with a rectangular transverse cross section.

Figure 2:
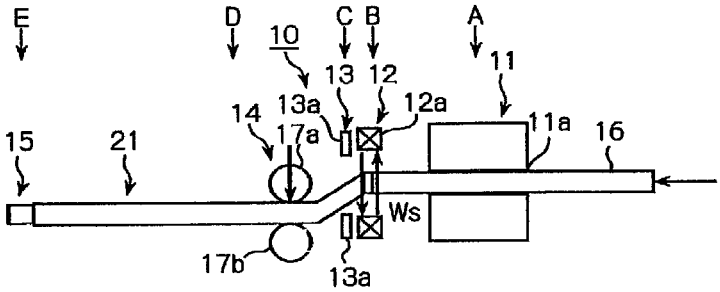
FIG. 2 is an explanatory view schematically showing an example of the structure of a manufacturing apparatus according to the present invention.

FIG. 1 is a perspective view showing in partially simplified and abbreviated form an example of the structure of a manufacturing apparatus 10 according to the present invention. FIG. 2 is an explanatory view schematically showing an example of the structure of this manufacturing apparatus 10.

As shown in FIG. 1 and FIG. 2, this manufacturing apparatus 10 has a first support device 11, a heating device 12, a cooling device 13, a shear force applying device 14, and a second support device 15.

[First Support Device 11]

As shown in FIG. 1, first, a rectangular tube 16 is fed in its lengthwise direction by an unillustrated feed device. The rectangular tube 16 has a hollow rectangular closed cross-sectional shape. The rectangular tube 16 is an elongated blank made of steel and having an integral structure in its lengthwise direction.

The feed device feeds the rectangular tube 16 in its lengthwise direction. An example of the feed device is a type using an electric servo cylinder, but the feed device is not limited to any particular type, and all types of feed devices which is known in the art such as a type using a ball screw or a type using a timing belt or chain can be similarly used.

In the example shown in FIG. 1, an example is given of the case in which a rectangular tube 16 having a rectangular transverse cross-sectional shape is used as a blank to be worked (bent). However, a blank used in the present invention is not limited to a rectangular tube 16, and hollow tubes made of steel or a metal other than steel and having a rectangular, elliptical, oval, square, or other various cross-sectional shapes can be used as the blank.

The rectangular tube 16 is fed by the feed device in its axial direction (lengthwise direction) at a predetermined feed speed. The rectangular tube 16 is supported at a first position A by a first support device 11. Namely, at the first position A, the first support device 11 supports the rectangular tube 16 which is fed in the axial direction by the feed device such that the tube can move.

In the example shown in FIGS. 1 and 2, a block is used as the first support device 11. The block has a through hole 11*a* through which the rectangular tube 16 passes with a clearance. Although not shown, a structure may be employed in which the block is divided into parts, and a hydraulic cylinder or air cylinder is connected to the block to support the rectangular tube. The first support device 11 is not limited to a particular structure, and any known support device of this type can be similarly used. For example, one or more sets of grooved rolls may be arranged in series.

In this manner, the rectangular tube 16 passes installation position A of the first support device 11 and is fed in its axial direction.

In the example shown in FIG. 1, the first support device 11 is mounted on and secured to a suitable mounting base 11*b*. However, the present invention is not limited to this manner, and any means which can secure the first support device 11 at a predetermined position can be used, and the invention is not limited to a specific manner of installation. For example, the first support device 11 may be supported by an end effector mounted on a conventional industrial robot.

The first support device 11 is constituted in the above-described manner.

[Heating Device 12]

The heating device 12 is secured at a second position B which is downstream of the first position A in the feed direction of the rectangular tube 16. The heating device 12 heats the entire periphery of a transverse cross section of a portion in the lengthwise direction of the rectangular tube 16 which is being fed.

In the example shown in FIGS. 1 and 2, an induction heating device is used as the heating device 12. This induction heating device can, for example, be one having a coil which can perform high frequency induction heating of the rectangular tube 16. Any known high frequency heating device of this type can be similarly used.

The heating coil 12*a* of the induction heating device 12 is spaced from the outer surface of the rectangular tube 16 by a predetermined distance, and it is disposed so as to surround the entire periphery of a transverse cross section in a portion of the lengthwise direction of the rectangular tube 16.

By varying the distance of the heating coil 12*a* with respect to the rectangular tube 16 in the directions perpendicular to and parallel to the axial direction of the rectangular tube 16, it is possible to perform nonuniform heating in the circumferential direction of the rectangular tube 16 which is being fed.

Although not shown in the drawings, it is preferred that at least one preheating device which can preheat the rectangular tube 16 (such as a small high frequency heating device) be disposed on the upstream side of the induction heating device 12 in the feed direction of the rectangular tube 16 and that the rectangular tube 16 be heated by combined use of the preheating device and the induction heating device 12. In this manner, the rectangular tube 16 can be heated multiple times, or a portion of the rectangular tube 16 can be nonuniformly heated in the circumferential direction.

The rectangular tube 16 is rapidly locally heated by the induction heating device 12.

Any means which can secure the heating device 12 at a predetermined position can be used as an installation means for the heating device 12, and there is no particular limitation on the manner of installation. For example, the heating device can be mounted on and secured to a fixed base, or it can be supported by an end effector mounted on a conventional industrial robot.

The heating device 12 is constituted in the above-described manner.

[Cooling Device 13]

The cooling device 13 is disposed at a third position C which is downstream of the second position B in the feed direction of the rectangular tube 16. The cooling device 13 rapidly cools the portion that was heated at the second position B.

As a result of cooling the rectangular tube 16 with the cooling device 13, the portion between a first portion which is the portion being heated by the heating device 12 and a second portion which is the portion being cooled by the cooling device 13 is in a state having a high temperature and hence a greatly decreased resistance to deformation.

The cooling device 13 can be any device which can obtain a desired cooling speed, and it is not limited to a specific type of cooling device. In general, it is preferable to use a water cooling device which cools the rectangular tube 16 by spraying cooling water towards a predetermined position on the outer peripheral surface of the rectangular tube 16. In this example, as shown in FIG. 1 and FIG. 2, a number of cooling water spraying nozzles 13*a* are disposed immediately downstream of the heating device 12 and are spaced from the outer surface of the rectangular tube 16 so as to surround a transverse cross section in a portion of the lengthwise direction of the rectangular tube 16. Cooling water is sprayed from these cooling water spraying nozzles 13*a* towards the outer surface of the rectangular tube 16.

The cooling water is preferably sprayed diagonally in the feed direction of the rectangular tube 16 so as not to interfere with heating of the rectangular tube 16 by the heating device 12.

If the amount of cooling water sprayed from each of the cooling water spray nozzles 13*a* is individually controlled for each of the cooling water spraying nozzles 13*a*, it is possible to cool a portion of the rectangular tube 16 nonuniformly in the circumferential direction. If the distance between each cooling water spraying nozzle 13*a* and the rectangular tube 16 in the directions perpendicular to and parallel to the axial direction of the rectangular tube 16 is varied, it is possible to control the heating region of the rectangular tube 16 in the axial direction.

The portion of the rectangular tube 16 which was heated by the induction heating device 12 is rapidly cooled by the water cooling device 13.

By adjusting the temperature at the start of water cooling by the cooling device 13 and the cooling speed, it is possible to perform quench hardening or annealing of all or a portion of the rapidly cooled portion of the rectangular tube 16.

As a result, the strength of all or a portion of the bent portion of the rectangular tube 16 can be greatly increased, for example, to 1500 MPa or above.

The cooling device 13 can be installed using any means which can secure the cooling device 13 at a predetermined position, and the means for installation is not limited to any particular structure. However, in order to manufacture a bent member 21 having a high dimensional accuracy using a manufacturing apparatus 1 according to the present invention, the region between the first portion in which the tube is heated by the heating device 12 and the second portion in which the tube is cooled by the cooling device 13 is preferably set to be as small as possible by making the distance from position B to position C as short as possible. For this purpose, the cooling water spraying nozzles 13*a* are preferably disposed close to the high frequency heating coil 12*a*, so the cooling water spraying nozzles 13*a* are preferably secured in a position immediately after the induction heating coil 12*a*.

By providing water supply holes in the high frequency heating coil 12*a* and using the cooling water for the high frequency heating coil 12*a* as cooling water which is sprayed toward the rectangular tube, the distance from position B to position C can be minimized, and this cooling system can be combined with the water cooling device 13.

When the feed speed of the rectangular tube 16 is slow, natural cooling can be used instead of the water cooling device 13.

The cooling means 13 is constituted as described above.

[Shear Force Applying Device 14]

The shear force applying device 14 is disposed in a region D which is downstream of the third position C in the feed direction of the rectangular tube 16. The shear force applying device 14 moves two-dimensionally or three-dimensionally while positioning the rectangular tube 16. As a result of this movement, the shear force applying device 14 applies a shear force to the region of the rectangular tube 16 between the first portion in which the tube is heated by the heating device 12 and the second portion in which it is cooled by the cooling device 13 to carry out working of the rectangular tube 16.

In the example shown in FIGS. 1 and 2, a pair of upper and lower rolls 17*a* and 17*b* is used as the shear force applying device 14. The upper and lower rolls 17*a* and 17*b* position the rectangular tube 16 by contacting the outer surface of the rectangular tube 16 while being rotated by the rectangular tube in the directions shown by arrows in FIG. 1.

The upper and lower rolls 17*a* and 17*b* are supported so as to be able to rotate by an unillustrated support frame. The support frame is held by a moving mechanism (not shown in the drawings) which supports the support frame so as to be able to move two-dimensionally or three-dimensionally.

Figure 3:
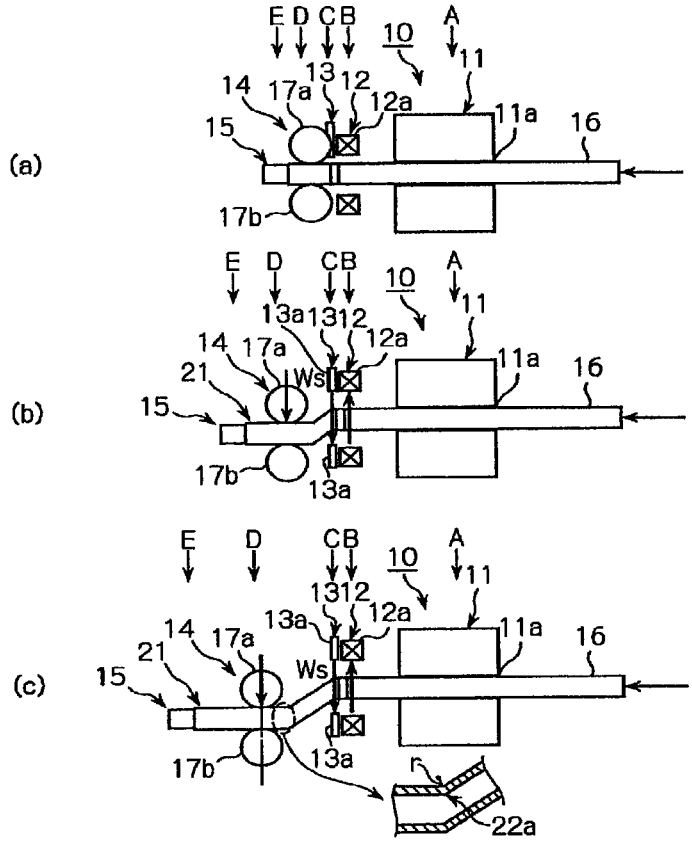
FIGS. 3(*a*)-(*c*) are explanatory views showing the state with the passage of time when carrying out a manufacturing method according to the present invention.

FIGS. 3(*a*)-3(*c*) are explanatory views showing the state with the passage of time when carrying out a manufacturing method according to the present invention. These figures show the state over time during working of the rectangular tube 16 to form a bent member 21 having a bent portion with an extremely small bend radius as shown in FIG. 3(*c*), FIG. 1, or FIG. 2.

As shown in FIGS. 3(*a*)-3(*c*), FIG. 1, and FIG. 2, at the start of working, the upper and lower rolls 17*a* and 17*b* are in an initial position shown in FIG. 3(*a*) (the position shown by one-dash chain lines in FIG. 1).

When working of the rectangular tube 16 commences, the moving mechanism to which is input a control signal from an unillustrated work control unit moves the upper and lower rolls 17*a* and 17*b* which are rotatably supported by the unillustrated support frame in a direction (the direction sloping downwards to the left in FIGS. 3(*a*)-3(*c*)) which is a composite of the feed direction of the rectangular tube 16 (to the left in FIGS. 3(*a*)-3(*c*)) and a direction generally parallel to a transverse cross section in the lengthwise direction of the rectangular tube 16 which was heated by the heating device 12 (downwards in FIGS. 3(*a*)-3(*c*)) with the above-described initial position as a starting point.

As a result, the upper and lower rolls 17*a* and 17*b* simultaneously move as shown by the solid bold arrow in FIG. 1 in a direction (diagonally downwards to the left in FIGS. 3(*a*)-3(*c*)) which is a composite of the feed direction of the rectangular tube 16 (to the left in FIGS. 3(*a*)-3(*c*)) and a direction generally parallel to a transverse cross section in the lengthwise direction of the rectangular tube 16 which was heated by the heating device 12 (downwards in FIGS. 3(*a*)-3(*c*)) with the above-described initial position as a starting point while contacting the outer surface of the rectangular tube 16 being fed (see FIG. 3(*b*)).

The upper and lower rolls 17*a* and 17*b* move to the position shown in FIG. 3(*c*) (the position shown by solid lines in FIG. 1) to complete working.

The shear force applying device 14 is constituted as described above.

[Second Support Device 15]

The second support device 15 has a function to cause shearing deformation of the heated portion of the rectangular tube 16 in a region E which is downstream of the installation position of the shear force applying device 14 in the feed direction of the rectangular tube 16.

As manufacture of a bent member 21 by the manufacturing apparatus 10 shown in FIGS. 1-3 progresses, if only the pair of rolls 17*a* and 17*b* is used, deformation of the heated portion of the rectangular tube 16 ends up being primarily bending deformation. Therefore, by placing constraint on the tube 16 at one more point, it becomes possible to produce the shearing deformation as shown in FIGS. 1-3.

As deformation takes place, the weight of the portion which has exited from the roll 17*a* and 17*b* increases, and due to its own weight, there is the possibility of the portion which has exited from the rolls 17*a* and 17*b* being deformed, with the portion which is positioned between the rolls 17*a* and 17*b* acting as a fulcrum. The second support device 15 is disposed in a region E downstream of the installation position of the shear force applying device 14 in the feed direction of the rectangular tube 16. The second support device 15 supports the portion of the rectangular tube 16 on which bending by the shear force applying device 14 has been completed. As a result, the second support device 15 prevents deformation of the rectangular tube 16, and a bent member 21 having high dimensional accuracy is manufactured.

A transverse cross section in a portion of the lengthwise direction of the rectangular tube 16 is heated by the heating device 12, and its resistance to deformation is greatly decreased. Therefore, by three-dimensionally moving the position of the upper and lower rolls 17*a* and 17*b* which constitute the shear force applying device 14 in region D downstream of the third position C in the feed direction of the rectangular tube 16 as explained with reference to FIGS. 3(*a*)-3(*c*), it is possible, as shown in FIGS. 3(*b*) and 3(*c*), to apply a shear force Ws to the region of the rectangular tube 16 between the first portion in which the tube is heated by the heating device 12 and the second portion in which it is cooled by the cooling device 13.

The rectangular tube 16 is worked by this shear force Ws to form a bent portion 22*a*. In the present invention, in contrast to the invention disclosed in Patent Document 1 in which a bending moment is applied, a shear force is applied to the heated portion of the rectangular tube 16. Therefore, as shown in the enlarged view in FIG. 3(*c*), it is possible to manufacture a bent member 21 having a bent portion 22*a* with an extremely small bend radius r such as 1 to 5 times the wall thickness of the tube.

In the present invention, the rectangular tube 16 is subjected to working by applying a shear force Ws to the region between the first portion and the second portion. Accordingly, there is no decrease in dimensional accuracy caused by the occurrence of wrinkles or a collapse of the cross-sectional shape on the inner peripheral side of the bent portion 22*a*, and extremely good dimensional accuracy in which the cross-sectional shape of the tube at four locations 16*a*, 16*b*, 16*c*, and 16*d* shown by hatching in FIG. 1 is the same is obtained.

In the present invention, bending of a rectangular tube 16 into a bent member 21 is carried out without using a die and without applying pressure to the interior of the rectangular tube 16, so it is performed at a low cost and with certainty.

The shear force applying device 14 may be installed using a mechanism by means of which the upper and lower rolls 17*a* and 17*b* can move two-dimensionally or three-dimensionally as described above. There are no particular limitations on such a mechanism. For example, a support frame for the rolls 17*a* and 17*b* can be held by an end effector mounted on a conventional industrial robot.

In the example shown in FIGS. 1-3, a chuck 18 is inserted inside the front end of the portion of the rectangular tube 16 on which working by the shear force applying device 14 has been completed. The second support device 15 is constituted by a vertical articulated industrial robot 20. On its wrist, the articulated industrial robot 20 has an end effector 19 which holds the chuck 18 which projects outwards from the above-mentioned front end of the rectangular tube.

The second support device 15 is not limited to a specific type as long as it to can prevent deformation of the portion of the rectangular tube 16 on which working by the shear force applying means 14 has been completed.

The manufacturing apparatus 10 according to the present invention is constituted as described above. Next, the state when manufacturing a bent member 21 according to the present invention using this manufacturing apparatus 10 will be explained.

In FIGS. 1-3, first, a steel tube such as an elongated hollow rectangular tube is supported by a first support device 11 disposed at a first position A while undergoing relative feeding in its lengthwise direction by an unillustrated feed device.

Next, the rectangular tube 16 being fed is rapidly locally heated by the heating device 12. The heating temperature of the rectangular tube 16 is preferably at least the $Ac_3$ point of the steel constituting the rectangular tube 12. By heating to at least the $Ac_3$ point, it is made possible to perforin quench hardening of the bent portion 22*a* of the bent member 21 by suitably setting the cooling speed at the time of subsequent cooling and to decrease the resistance to deformation between the first portion and the second portion of the rectangular tube 16 to an extent sufficient to perform working with a desired small bend radius.

Cooling water is sprayed at the rectangular tube 16 from the cooling water spraying nozzles 13*a* of the cooling device 13 disposed at the downstream of the second position B in the feed direction of the rectangular tube 16. As a result, the heated portion is cooled at the third position B. If the cooling speed at this cooling is at least 100° C./minute, it is possible to perform quench hardening of the bent portion 22*a* and increase its strength, although the necessary cooling speed depends upon the type of steel forming the rectangular tube 16.

As a result of this cooling, a first portion in which the tube is heated by the heating device 12 and a second portion in which it is cooled by the cooling device 13 are formed in the rectangular tube 16. The region between the first portion and the second portion of the rectangular tube 16 is at a high temperature and its resistance to deformation is greatly decreased.

When the front end of the portion to be worked of the rectangular tube 16 reaches the pair of rolls 17*a* and 17*b* of the shear force applying device 14, as explained with reference to FIGS. 1-3, the rolls 17*a* and 17*b* are moved in a direction (diagonally downwards to the left in FIGS. 3(*a*)-3(*c*)) which is a composite of the feed direction of the rectangular tube 16 (to the left in FIGS. 3(*a*)-3(*c*)) and a direction generally parallel to a transverse cross section in the lengthwise direction of the rectangular tube 16 which was heated by the heating device 12 (downwards in FIGS. 3(*a*)-3(*c*)) with the initial position as a starting point by moving the second support device 15 and the upper and lower rolls 17*a* and 17*b* which are rotatably supported by an unillustrated support frame.

The portion of the rectangular tube 16 on which working by the shear force applying device 14 has been completed is supported by the second support device 15 which is disposed in a region E downstream of the installation position of the shear force applying device 14 in the feed direction of the rectangular tube 16. Therefore, the rectangular tube 16 is not deformed, and a bent member 21 having a desired shape and dimensional accuracy is manufactured.

In this manner, a shear force is applied to the region between the first and second portions of the rectangular tube 16 to carry out working on the rectangular tube 16.

In this example, the portion of the rectangular tube 16 on which working by the shear force applying device 14 has been completed is always supported by the second support device 15 during working. Therefore, when working is completed on one bent portion 22*a* of the rectangular tube 16, it is possible to temporarily increase the roll gap between the pair of rolls 17*a* and 17*b* and return the rolls 17*a* and 17*b* to the above-mentioned initial position, thereby the rolls being ready for working to form the next bent portion of the rectangular tube 16.

In addition, if the second support device 15 is moved two-dimensionally or three-dimensionally when carrying out working with the pair of rolls 17*a* and 17*b* or when not performing bending with the pair of rolls 17*a* and 17*b* such as when the rolls are being returned to their initial position, a bent portion having a relatively large bend radius can be formed in the rectangular tube 16 due to a bending moment applied to the portion of the rectangular tube 16 between the first portion and the to second portion.

In this manner, as shown by the two-dash chain line in FIG. 1, it is possible with the present invention to manufacture a bent member 21 having an elongated hollow body 21*a* and bent portions 22*a*, 22*b* formed in the body 21*a* in which the hollow body 21*a* is made of steel and has a closed cross-sectional shape and an integral structure in the lengthwise direction and the bent portions 22*a*, 22*b* are bent two-dimensionally or three-dimensionally and have an extremely small bend radius r such as at most 1-5 times the wall thickness.

This bent member 21 has absolutely no decrease in dimensional accuracy caused by the occurrence of wrinkles or a collapse of the cross-sectional shape on the inner peripheral side of the bent portions 22*a* and 22*b* at any location in the lengthwise direction and hence has extremely high dimensional accuracy.

Because the bent member 21 has a hollow flat closed cross-sectional shape, it is small and lightweight. By suitably adjusting the starting temperature and the cooling speed of water cooling by the cooling means 13 as described above so as to greatly increase the tensile strength of the steel such as to at least 1500 MPa, it is possible to achieve a further reduction in size and weight and a further increase in strength.

By carrying out quench hardening by suitably adjusting the starting temperature and cooling speed of water cooling by the cooling device 13 as described above, a compressive residual stress is formed in the outer surface of the bent member 21, whereby its fatigue strength is increased.

Figure 4:
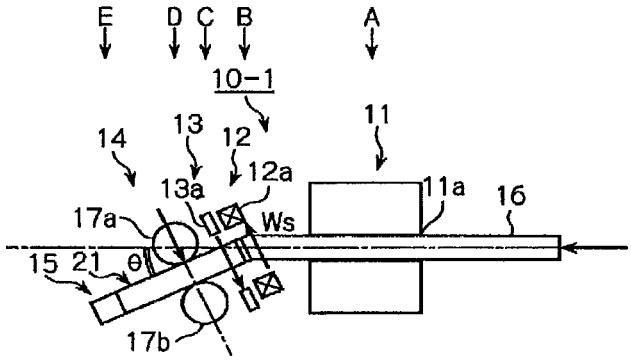
FIG. 4 is an explanatory view schematically showing another example of the structure of a manufacturing apparatus according to the present invention.

FIG. 4 is an explanatory view schematically showing another example of the structure of a manufacturing apparatus 10-1 according to the present invention.

The difference between manufacturing apparatus 10-1 and the above-described manufacturing apparatus 10 is that the induction heating coil 12*a* which constitutes the heating device 12 is sloped with respect to the rectangular tube 16 and that the cooling water spraying nozzles 13*a* of the cooling device 13 and the rolls 17*a* and 17*b* of the shear force applying device 14 are correspondingly sloped with respect to the rectangular tube 16.

As shown in FIG. 4, by disposing the induction heating coil 12*a*, the cooling water spraying nozzles 13*a*, and the rolls 17*a* and 17*b* so as to slope with respect to the rectangular tube 16, a decrease in the wall thickness of the rectangular tube 16 can be prevented. Namely, in FIG. 4, when the wall thickness of the rectangular tube 16 before working is t, the wall thickness becomes t-cos θ if working is carried out with the usual setting of the heating coil. However, by sloping the induction heating coil 12*a*, the wall thickness after working can be maintained at t, and a decrease in the wall thickness after working can be prevented.

Figure 5:
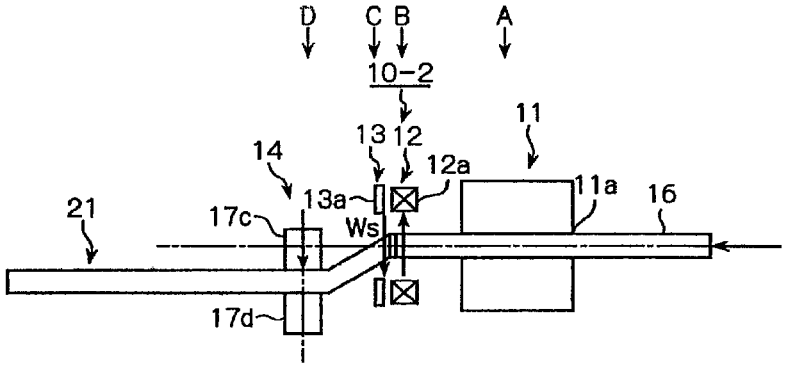
FIG. 5 is an explanatory view showing yet another example of the structure of a manufacturing apparatus according to the present invention.

FIG. 5 is an explanatory view schematically showing the structure of still another example of a manufacturing apparatus 10-2 according to the present invention.

The difference between this manufacturing apparatus 10-2 and the above-described manufacturing apparatus 10 is that instead of using a pair of rolls 17*a* and 17*b*, it uses a pair of clamping devices 17*c* and 17*d* which grip the rectangular tube 16.

In this case, the clamping apparatuses 17*c* and 17*d* continue to grip the rectangular tube 16 until the completion of working on the rectangular tube 16. Therefore, it is not necessary to provide a second support device 15 which is used in manufacturing apparatus 10. The clamping apparatuses 17*c* and 17*d* may, for example, be held by a vertical articulated industrial robot.

In the above explanation, an example was given of a mode in which a blank in the form of a rectangular tube 16 is fed in its lengthwise direction, and the first support means 11, the heating means 12, and the cooling means 13 are fixed with respect to the feed direction of the rectangular tube 16. However, the present invention is not limited to this mode, and conversely, a blank in the form of a rectangular tube 16 may be fixed in place, and the first support device 11, the heating device 12, and the cooling device 13 may be movable in the lengthwise direction of the rectangular tube 16.

Figure 6:
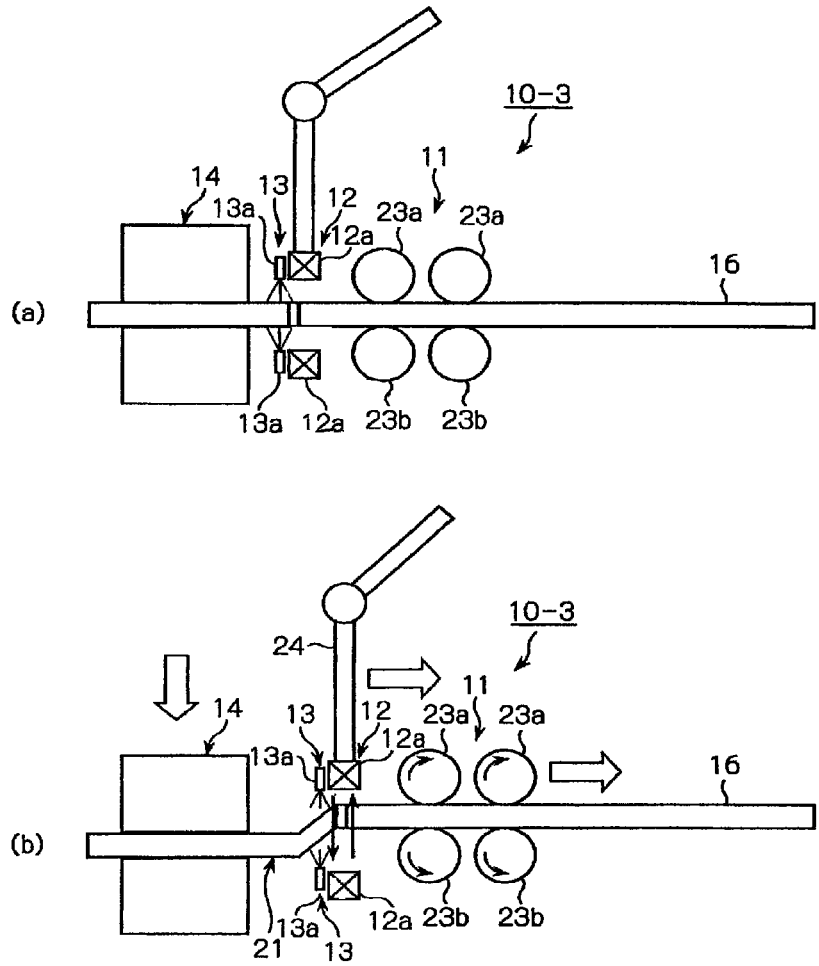
FIGS. 6(*a*) and (*b*) are explanatory views schematically showing a further example of the structure of a manufacturing apparatus according to the present invention with the passage of time.
Figure 7:
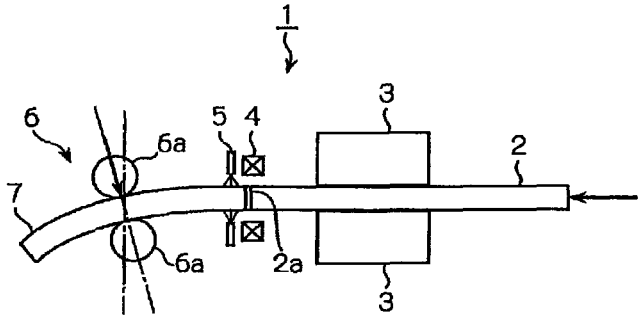
FIG. 7 is an explanatory view schematically showing an outline of a bending apparatus disclosed in Patent Document 1.
Figure 8:
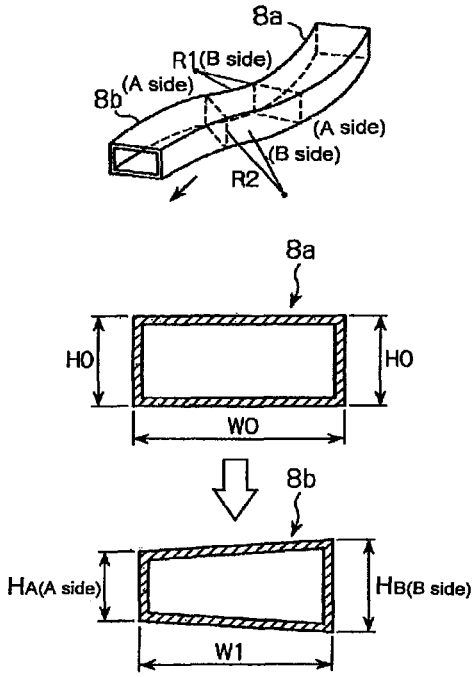
FIG. 8 is an explanatory view showing an example of the change in the dimensions of a cross section before and after bending disclosed in Patent Document 1 and Non-Patent Document 2.

FIGS. 6(*a*) and 6(*b*) are explanatory views schematically showing another example of the structure of a manufacturing apparatus 10-3 according to the present invention with the passage of time. FIG. 6(*a*) shows the state before working, and FIG. 6(*b*) shows the state during working.

In this manufacturing apparatus 10-3, the first support device 11 has two sets of roll pairs 23*a* and 23*b*. The pairs of rolls 23*a* and 23*b* are rotatably supported by an unillustrated support frame. The support frame is held by an industrial robot (not shown) which holds the support frame so as to be movable two-dimensionally or three-dimensionally. As a result, both sets of roll pairs 23*a* and 23*b* can move three-dimensionally in a direction which includes the axial direction of the rectangular tube 16.

The induction heating coil 12*a* of the heating device 12 and the cooling water spraying nozzles 13*a* of the cooling device 13 are supported by an industrial robot 24. The induction heating coil 12*a* is disposed on the upstream side of the cooling water spraying nozzles 13*a* in the relative feed direction (from the left to the right in FIGS. 6(*a*) and 6(*b*)) with respect to the pairs of rolls 23*a* and 23*b* for the blank 16.

In this manner, the induction heating coil 12*a* and the cooling water spraying nozzles 13*a* can move three-dimensionally in a direction including the axial direction of the rectangular tube 16.

The shear force applying device 14 moves while clamping and supporting the rectangular tube 16. The shear force applying device 14 is constituted by a hydraulic clamp which is supported by an industrial robot (not shown). In this manner, the shear force applying device 14 can move the rectangular tube 16 three-dimensionally in a direction including the axial direction of the rectangular tube.

The rectangular tube 16 is fixed in place in its axial direction. In contrast to this example, it is also possible to dispose the rectangular tube 16 so that it can move in its axial direction.

Thus, the manufacturing apparatus 10-3 has a first support device 11 which supports a blank in the form of a rectangular tube 16 while performing relative feeding of the rectangular tube in its lengthwise direction, a heating device 12 which heats the rectangular tube 16, a cooling device 13 which cools a second portion of the tube situated downstream of a first portion in which heating was performed by the heating device 12 in the relative feed direction of the rectangular tube 16, and a shear force applying device 14 which applies a shear force to the tube in the location between the first portion and the second portion by moving two-dimensionally or three-dimensionally.

With this manufacturing apparatus 10-3, by moving the first support device 11, the heating device 12, the cooling device 13, and the shear force applying device 14 in the axial direction of the rectangular tube 16 while securing the rectangular tube 16 in place, the rectangular tube 16 (blank) undergoes relative feeding in the lengthwise direction with respect to the first support device 11 which supports the rectangular tube 16. Working of the rectangular tube 16 is carried out by heating the blank by the heating device 12, cooling the second portion of the tube positioned downstream of the first portion in which tube was heated by the heating device 12 in the relative feed direction of the rectangular tube 16 by the cooling device 13, and moving the shear force applying device 14 two-dimensionally or three-dimensionally, the device 14 capable of applying a shear force between the first portion and the second portion by moving two-dimensionally or three-dimensionally.

In this manner, a bent member 21 can be manufactured even if the rectangular tube 16 is fixed in place and the first support device 11, the heating device 12, and the cooling device 13 are movable in the lengthwise direction of the rectangular tube 16.

A manufacturing process for a bent member 21 according to the present invention which was explained while referring to FIG. 1 is extremely simple and can perform manufacture at a low cost.

In the above explanation, an example was given of a mode in which a rectangular tube 16 only undergoes deformation by a pure shear force, but the present invention is not limited to this mode. Namely, by adding deformation produced by a shear force to conventional bending deformation, smaller bending deformation than is conventional is obtained. Therefore, the present invention is directed to working which produces deformation including a component produced by shear force.

The bent member 21 is manufactured by subjecting to heat treatment (such as hardening) at the same time as working by means of shear force. Therefore, compared to the bent member disclosed in Non-Patent Document 3 which is manufactured by carrying out heat treatment (such as quench hardening) after carrying out bending by shearing in a cold state, a bent member having a portion with a high strength of at least 1500 MPa can be manufactured with high working accuracy by local quench hardening.

A bent member 21 manufactured by a manufacturing method according to the present invention can be used in applications such as the following (i)-(vii).

(i) Structural members for an automobile body such as a front side member, a cross member, a side member, a suspension member, a roof member, reinforcement for an A pillar, reinforcement for a B pillar, and reinforcement for a bumper.

(ii) Strength members and reinforcing members for an automobile such as a seat frame or a seat cross member.

(iii) Components of an exhaust system such as an exhaust pipe of an automobile.

(iv) A frame and a crank for an automobile or motorcycle.

(v) Reinforcing members of an electric railway car or the like or components of a bogie (a bogie frame, various beams, or the like).

(vi) Components of a frame or a reinforcing member for a ship hull.

(vii) Strength members, reinforcing members, and structural members of a household electrical appliance.

The invention claimed is:

1. An apparatus for manufacturing a bent member comprising:

a heating device which heats a hollow metal blank, a cooling device which cools a second portion of the blank downstream of a first portion thereof which is heated by the heating device in the relative feed direction of the blank, and a shear force applying and supporting device including a shear force applying unit which applies a shear force to the blank between the first portion and the second portion by moving the blank relatively to the heating device and the cooling device two-dimensionally or three-dimensionally in a composite direction of a lengthwise direction of the blank and a direction generally parallel to a transverse cross section in the lengthwise direction of the blank and a supporting unit which supports the blank downstream of the cooling device in the relative feed direction of the blank and which moves relatively to the heating device in the composite direction.

2. The apparatus as set forth in claim 1 wherein the shear force applying unit applies the shear force to the blank between the first portion and the second portion by moving the blank relatively to the heating device and the cooling device in the composite direction while positioning the blank by contacting the outer surface of the blank.

3. The apparatus as set forth in claim 1 wherein the shear force applying unit applies the shear force to the blank between the first portion and the second portion by moving the blank relatively to the heating device and the cooling device in the composite direction while positioning the blank by contacting the outer surface of the blank, the outer surface being sloped along the composite direction.

4. The apparatus as set forth in claim 3 wherein the heating device and the cooling device are sloped along the composite direction.

5. The apparatus as set forth in claim 2 wherein the shear force applying unit is a pair or rolls.

6. The apparatus as set forth in claim 3 wherein the shear force applying unit is a pair of rolls.

7. The apparatus as set forth in claim 2 wherein the supporting unit supports the blank downstream of the shear force applying unit in the relative feed direction of the blank.

8. The apparatus as set forth in claim 3 wherein the supporting unit supports the blank downstream of the shear force applying unit in the relative feed direction of the blank.

9. The apparatus as set forth in claim 5 wherein the supporting unit supports the blank downstream of the shear force applying unit in the relative feed direction of the blank.

10. The apparatus as set forth in claim 6 wherein the supporting unit supports the blank downstream of the shear force applying unit in the relative feed direction of the blank.

11. The apparatus as set forth in claim 1 wherein the shear force applying and support device is a clamping device which clamps or grips the blank.

12. The apparatus as set forth in claim 1, further comprising a feeding and supporting device which supports the blank while relatively feeding the blank in the lengthwise direction, wherein the feeding and supporting device, the heating device, and the cooling device are each fixed in place, the feeding and supporting device is disposed at a first position, the heating device is disposed at a second position downstream of the first position in the relative feed direction of the blank, the cooling device is disposed at a third position downstream of the second position in the feed direction of the blank, and the shear force applying and supporting device is disposed in a region downstream of the third position in the relative feed direction of the blank.

13. The apparatus as set forth in claim 2, further comprising a feeding and supporting device which supports the blank while relatively feeding the blank in the lengthwise direction, wherein the feeding and supporting device, the heating device, and the cooling device are each fixed in place, the feeding and supporting device is disposed at a first position, the heating device is disposed at a second position downstream of the first position in the relative feed direction of the blank, the cooling device is disposed at a third position downstream of the second position in the feed direction of the blank, and the shear force applying and supporting device is disposed in a region downstream of the third position in the relative feed direction of the blank.

14. The apparatus as set forth in claim 3, further comprising a feeding and supporting device which supports the blank while relatively feeding the blank in the lengthwise direction, wherein the feeding and supporting device, the heating device, and the cooling device are each fixed in place, the feeding and supporting device is disposed at a first position, the heating device is disposed at a second position downstream of the first position in the relative feed direction of the blank, the cooling device is disposed at a third position downstream of the second position in the feed direction of the blank, and the shear force applying and supporting device is disposed in a region downstream of the third position in the relative feed direction of the blank.

15. The apparatus as set forth in claim 1 further comprising a support device which supports the blank and which is provided upstream of the heating device in the relative field direction of the blank, wherein the supporting device, the heating device, and the cooling device are arranged movably with respect to the lengthwise direction of the blank.

16. The apparatus as set forth in claim 1 wherein the bent member includes at least one bent portion with a bend radius which is at most 1-5 times of a wall thickness of the bent portion.

17. The apparatus as set forth in claim 1 wherein the bent member has a closed cross-sectional shape and an integral structure in its lengthwise direction.

18. A method of manufacturing a bent member comprising:

carrying out working of a hollow metal blank by applying a shear force to the blank between a first position thereof and a second portion thereof located downstream of the first portion in a relative feed direction of the blank by moving the blank with a shear force applying unit of a shear force applying and supporting device relatively to a heating device and a cooling device two-dimensionally or three-dimensionally in a composite direction of a lengthwise direction of the blank and a direction generally parallel to a transverse cross section in the lengthwise direction of the blank while heating the first portion of the blank with a heating device, cooling the second portion of the blank with a cooling device, supporting the blank downstream of the cooling device in the relative feed direction of the blank with a supporting unit of the shear force applying and supporting device, and relatively moving the supporting unit in the composite direction with respect to the heating device.

19. The method as set forth in claim 18 wherein quenching is carried out between the first portion and the second portion.

20. The method as set forth in claim 18 wherein the shear force applying unit applies the shear force to the blank between the first portion and the second portion by moving the blank relatively to the heating device and the cooling device in the composite direction while positioning the blank by contacting the outer surface of the blank.

21. The method as set forth in claim 18 wherein the shear force applying unit applies the shear force to the blank between the first portion and the second portion by moving the blank relatively to the heating device and the cooling device in the composite direction while positioning the blank by contacting the outer surface of the blank, the outer surface being sloped along the composite direction.

22. The method as set forth in claim 21 wherein the heating device and the cooling device are sloped along the composite direction.

23. The method as set forth in claim 20 wherein the shear force applying unit is a pair of rolls.

24. The method as set forth in claim 21 wherein the shear force applying unit is a pair of rolls.

25. The method as set forth in claim 20 wherein the supporting unit supports the blank downstream of the shear force applying unit in the relative feed direction of the blank.

26. The method as set forth in claim 21 wherein the supporting unit supports the blank downstream of the shear force applying unit in the relative feed direction of the blank.

27. The method as set forth in claim 23 wherein the supporting unit supports the blank downstream of the shear force applying unit in the relative feed direction of the blank.

28. The method as set forth in claim 24 wherein the supporting unit supports the blank downstream of the shear force applying unit in the relative feed direction of the blank.

29. The method as set forth in claim 18 wherein the shear force applying and supporting device is a clamping device which clamps or grips the blank.

30. The method as set forth in claim 18, further comprising a feeding and supporting device which supports the blank while relatively feeding the blank in the lengthwise direction, wherein the feeding and supporting device, the heating device, and the cooling device are each fixed in place, the feeding and supporting device is disposed at a first position, the heating device is disposed at a second position downstream of the first position, the heating device is disposed at a second position downstream of the first position in the relative feed direction of the blank, the cooling device is disposed at a third position downstream of the second position in the feed direction of the blank, and the shear force applying and supporting device is disposed in a region downstream of the third position in the relative feed direction of the blank.

31. The method as set forth in claim 20, further comprising a feeding and supporting device which supports the blank while relatively feeding the blank in the lengthwise direction, wherein the feeding and supporting device, the heating device, and the cooling device are each fixed in place, the feeding and supporting device is disposed at a first position, the heating device is disposed at a second position downstream of the first position, the heating device is disposed at a second position downstream of the first position in the relative feed direction of the blank, the cooling device is disposed at a third position downstream of the second position in the feed direction of the blank, and the shear force applying and supporting device is disposed in a region downstream of the third position in the relative feed direction of the blank.

32. The method as set forth in claim 21, further comprising a feeding and supporting device which supports the blank while relatively feeding the blank in the lengthwise direction, wherein the feeding and supporting device, the heating device, and the cooling device are each fixed in place, the feeding and supporting device is disposed at a first position, the heating device is disposed at a second position downstream of the first position in the relative feed direction of the blank, the cooling device is disposed at a third position downstream of the second position in the feed direction of the blank, and the shear force applying and supporting device is disposed in a region downstream of the third position in the relative feed direction of the blank.

33. The method as set forth in claim 18 wherein a supporting device which supports the blank is provided upstream of the heating device in the relative feed direction of the blank, and the supporting device, the heating device, and the cooling device are arranged movably with respect to the lengthwise direction of the blank.

34. The method as set forth in claim 18 wherein the bent member includes at least one bent portion with a bend radius which is at most 1-5 times a wall thickness of the bent portion.

35. The method as set forth in claim 18 wherein the bent member has a closed cross-sectional shape and an integral structure in its lengthwise direction.

* * * * *